United States Patent [19]

Arthur

[11] 4,319,851

[45] Mar. 16, 1982

[54] DEVICE FOR CLEANING RAIN GUTTERS

[76] Inventor: Frederick M. Arthur, 6300 Wyoming, St. Louis, Mo. 63139

[21] Appl. No.: 153,185

[22] Filed: May 27, 1980

[51] Int. Cl.[3] ..... B08B 9/00; A47L 25/00

[52] U.S. Cl. ..... 401/137; 401/9; 401/48; 401/193; 401/194; 401/195; 401/268; 401/261; 401/139; 15/160; 15/104.05; 15/111; 134/167 C; 239/532

[58] Field of Search ..... 401/9–11, 401/15, 28, 48, 137, 139, 268, 193–195, 261, 263, 265, 266; 239/532; 134/167 C, 168 C; 15/160, 111, 144 R, 104.05; 52/16

[56] References Cited

U.S. PATENT DOCUMENTS

| | | | |
|---|---|---|---|
| 367,379 | 8/1887 | England | 401/137 |
| 2,019,372 | 10/1933 | Thurley | 401/48 |
| 2,638,730 | 5/1953 | Davidson | 401/28 |
| 2,910,711 | 11/1959 | Mizzelle | 401/48 |
| 3,023,971 | 3/1962 | Milhous | 401/263 |
| 3,041,655 | 7/1962 | Entler | 401/263 |
| 3,094,728 | 6/1963 | White | 15/111 |
| 3,143,984 | 8/1964 | Morasch | 401/263 |
| 3,908,910 | 9/1975 | Detwiler | 239/532 |
| 4,150,793 | 4/1979 | Russo | 239/532 |
| 4,153,287 | 5/1979 | Towsend | 15/111 |
| 4,183,368 | 1/1980 | Husted | 134/198 |
| 4,253,813 | 3/1981 | Farrell, Jr. | 401/188 A |

*Primary Examiner*—William Pieprz

*Attorney, Agent, or Firm*—Grace J. Fishel

[57] ABSTRACT

A device for flushing, sweeping and scooping debris, snow and ice from roof gutters avoiding the need for climbing on ladders and roofs which in its preferred embodiment includes a means for seeing into said gutters from the ground.

5 Claims, 4 Drawing Figures

DEVICE FOR CLEANING RAIN GUTTERS

BACKGROUND OF THE INVENTION

This invention relates to the cleaning of rain gutters. It particularly relates to a manually operated device for the cleaning of rain gutters attached to edges of sloping roofs.

The accumulations of leaves, seeds, twigs, sand from shingles, insect colonies, dead insects and other unwanted debris have resulted in eventual clogging of leaders (downspouts) from the gutters so that the desired drainage does not occur. This results in an overflow over the edge of the gutter with consequent damage to shrubs and other plantings below. Such overflow may also result in abnormal settling of adjacent sidewalks and foundations, washout of brick tuck-pointing, unsightly stains to aluminum and plastic sidings, paint and gutterboard destruction and so forth. The clogging frequently results in the accumulating of water in the downspout which during a cold spell will freeze and burst the downspout.

The gutters and the openings into the downspouts can, of course, be cleaned by climbing up a ladder or working down from the roof to remove the accumulated debris. However, most people are uncomfortable climbing up a ladder, particularly if the gutters are high, or walking on sloping roofs, so the necessary cleaning is rarely done. Various means have, therefore, been developed to prevent the deposition and accumulation of debris in gutters and/or downspouts.

The placing of a screen mesh over the top of the gutters is frequently used. However, it has been found that materials of small size such as, for example, sand from shingles, insects, seedlings and the like readily pass through the one-half inch mesh screen commonly used and the undesired accumulations still result. While the screen can be lifted up to clean the gutters and/or the openings of the downspouts, this is not easily done. The sharp edges of the screen result in cuts in the hands of the cleaner. Furthermore, since the openings in the downspouts are usually at the corners of the roof, reaching them by either ladder or from the roof is awkward and dangerous. In most instances once the mesh screens have been placed over the gutters the owner of the house assumes that there will be no more accumulation of the debris and nothing further is done until damages, as discussed above, occur.

Another means of preventing accumulations of debris, particularly in the downspouts, is the insertion of a wire bulb screen unit in the collar of the downspout. However, once a few leaves fall on the screen they tend to stick to it, particularly if they are wet. Eventually, more and more debris accumulates around and on top of these leaves so that the drain becomes clogged and the water accumulating in the gutters has to flow over the sides.

Another accumulation which may result in clogging is snow or ice. If this accumulation is not removed before a rapid thaw sets in overflowing will occur. The placing of an electric heating tape at the base of the gutter has been used to melt the snow or ice. With increasing energy costs this becomes a rather expensive operation. Furthermore, the presence of the tape provides an area against which more debris may accumulate.

None of the means described above is useful for determining the condition of the gutters and the openings of the downspouts. To determine these conditions the owner still has to use a ladder or climb down on the sloping roof, either of which is unappetizing and dangerous. When ladders are used, care must be taken when placing them against the gutters to avoid denting or otherwise damaging them.

STATEMENT OF INVENTION

The present invention provides means for removing any debris, snow or ice which has accumulated in roof gutters without requiring the cleaner to climb up ladders or on roofs.

In accordance with the present invention there is provided a cleaning device for roof gutters which comprises an inverted U-shaped tube with arms of unequal length, the longer arm being of sufficient length to extend beyond the height of the gutter, the open end of said longer arm being adapted for connection to a source of water which passes through the tube. The longer arm serves as a handle for moving the device. The shorter arm of the inverted U-shaped tube projects downwardly into a scoop which fits inside the gutter and is attached to said shorter arm. The shorter arm is provided at its lower end with a plurality of openings for the release of the water, which openings preferably face toward the front of the scoop. The horizontal segment of the U-shaped tube preferably serves as a mount whereon a mirror is attached for providing the user a view of the inside of the gutter from the ground. Optionally, a scoop smaller than the one into which the shorter arm projects is secured to said larger scoop in back-to-back relationship. As shown, the bottoms of the scoops may be provided with brushes which serve to sweep the gutters.

The invention and the objects and attributes thereof will become more readily apparent from the description which follows taken in conjunction with the attached drawings.

DESCRIPTION OF EMBODIMENTS

Figure 1:
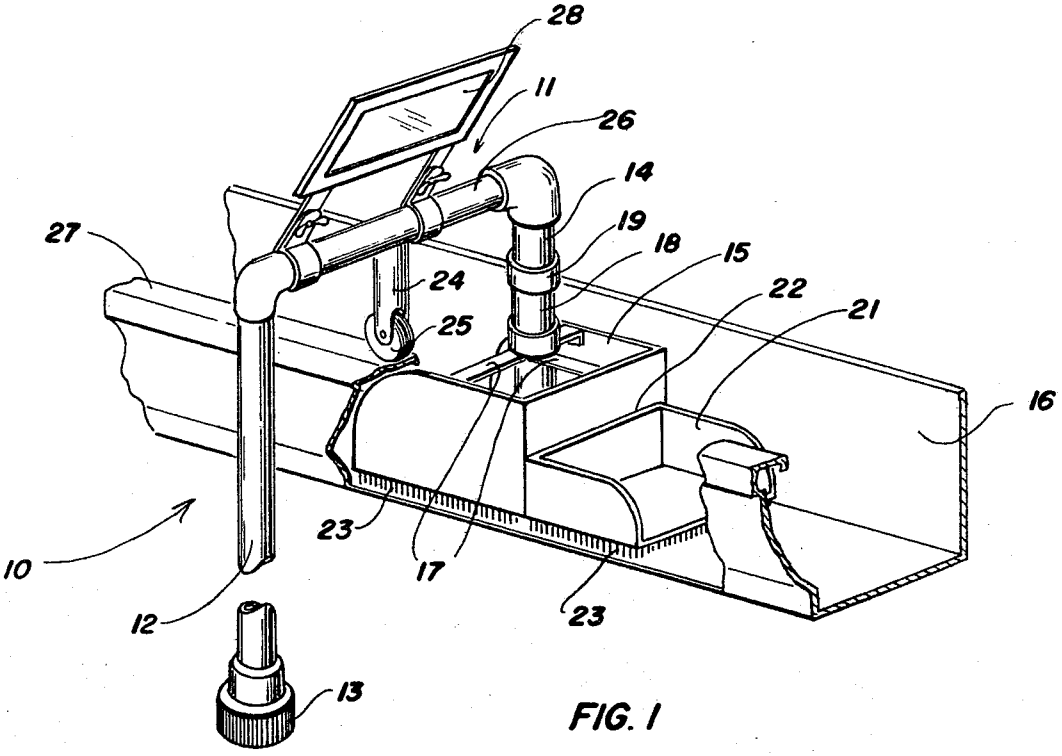
FIG. 1 is a rear perspective view of the device showing the scoop in place in the gutter, the front side of said gutter having been partially broken away to provide a better view of the device.
Figure 2:
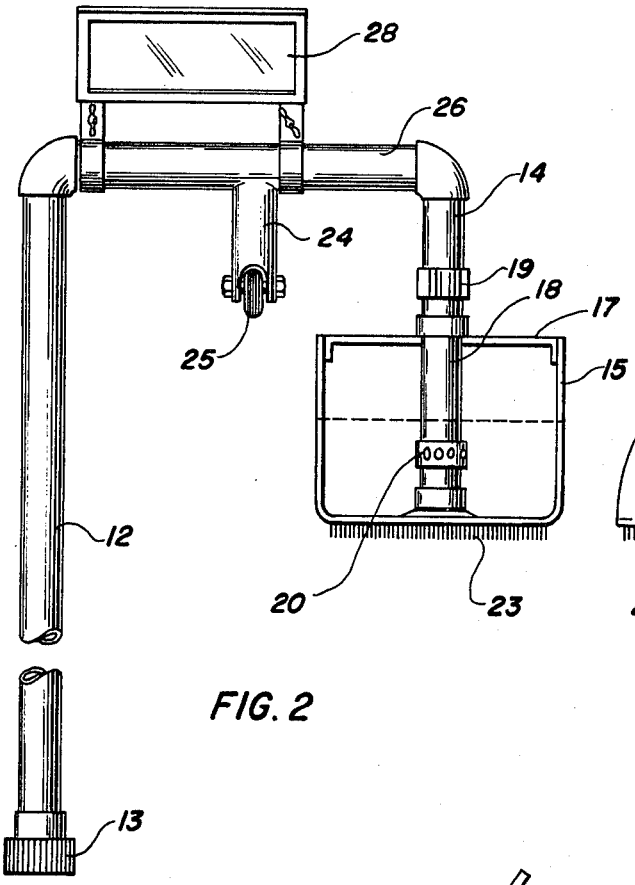
FIG. 2 is a front elevational view of the device.
Figure 3:
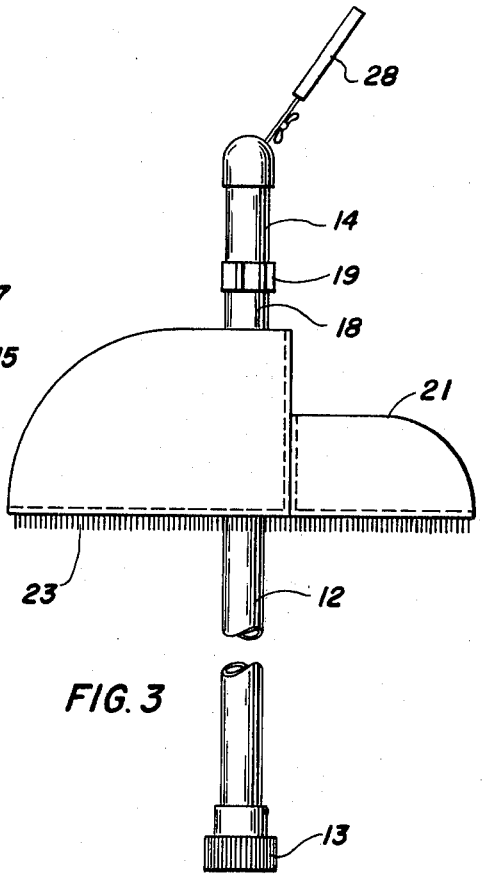
FIG. 3 is a side elevational view of the device.
Figure 4:
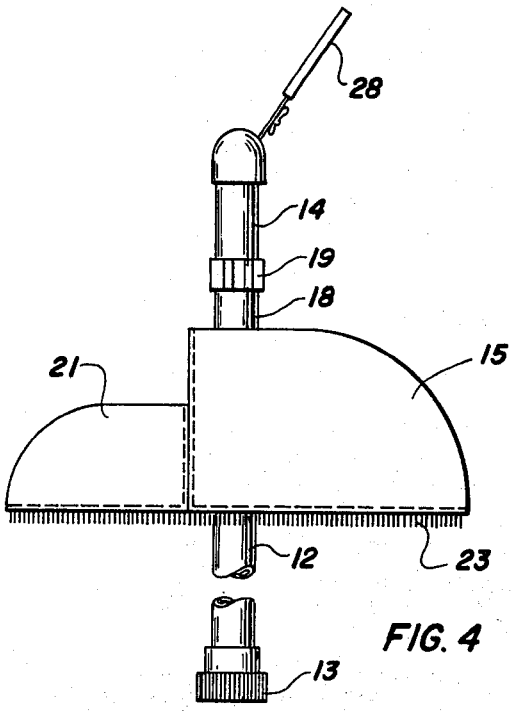
FIG. 4 is another side elevational view showing a 180 degree rotation in the position of the scoops.

Referring to the drawings wherein like numerals indicate like parts, the gutter cleaner 10 of the present invention comprises an inverted U-shaped tube 11 having arms of unequal length, the longer arm 12 being of sufficient length to reach over the top of the gutter and to the ground below. The longer arm is provided at its lower end with means 13 for connection to a source of water such as a garden hose. Any means for connecting garden hoses is suitable. The shorter arm 14 projects into a scoop 15 which fits into the gutter 16. The scoop is connected by means of projecting vanes 17 to the shorter arm. Preferably, the attachment of the scoop is to a tubular element 18 which is attached in rotatable relationship 19 to the end of the shorter arm. This permits rotation of the scoop to have it face in the opposite direction when so desired. The tube 18 is provided at its lower end with a plurality of openings 20, arranged semicircularly facing the front of the scoop. These openings serve as outlets for the water passing through the tube. A smaller scoop 21 may be arranged in back-to-back 22 relationship and secured to the larger scoop. Both scoops are preferably provided with brushes 23 on their bottom portions. While the scoops illustrated in the drawings have flat bottoms, this is not essential and the bottoms can be of any shape which will fit and permit movement inside the gutter. A rod on tubular element 14 to which there is attached a roller on wheel 25 projects downwardly from the horizontal segment 26 of the inverted U-shaped tube and is so positioned that the roller or wheel is set on the outer edge 27 of the gutter. This facilitates movement of the unit as the gutter is being cleaned and also serves to take some load off the user, particularly when cleaning gutters in a two-story house or the like. A mirror 28 is secured to and projects above the horizontal segment of the inverted U-shaped tube and is positioned at a proper angle to provide the user of the device with a view of the inside of the gutter as it is being cleaned.

The tube and scoop portions of the device of the present invention are preferably constructed of a light-weight substantially rigid plastic or metal material.

In use, the gutter cleaning device described above serves to flush, sweep and scoop debris that has accumulated in gutters while the user views the procedure safely from the ground. During the cold and snowy seasons the device can be used to remove any snow and ice that accumulates in the gutter by flushing with hot water.

In view of the above, it will be seen that the several objects of the invention are achieved and other advantageous results attained. As various changes could be made in the above described constructions without departing from the scope of the invention, it is intended that all matter contained in the above description or shown in the accompanying drawings shall be interpreted as illustrative and not in a limiting sense.

What is claimed is:

1. A cleaning device for roof gutters which comprises an inverted U-shaped tube with arms of unequal length, the longer arm being of sufficient length to extend beyond the height of the gutter and being adapted at its open end for connection to a source of water, and the shorter arm projecting downwardly into a scoop which fits inside the gutter and is positioned longitudinally with respect to said gutter and which is attached to the shorter arm, said shorter arm being provided at its lower end with a plurality of openings for the release of the water longitudinally of the gutter, which openings face toward the front of the scoop, said device further including a mirror which is attached to and above the horizontal segment of the inverted U-shaped tube, said mirror being positioned to provide the user of the device with a view of the inside of the gutter from the ground.

2. A cleaning device according to claim 1 wherein a scoop smaller than the scoop attached to the shorter arm is attached in back-to-back relationship with the larger scoop.

3. A cleaning device according to claim 2 wherein the outside bottom portions of said scoops are provided with brushes.

4. A cleaning device according to claim 3 wherein the shorter arm is in two segments, an upper segment which is part of the inverted U-shaped tube and a lower segment rotatably attached to said upper segment, and the larger scoop is attached to the lower segment.

5. A cleaning device according to claim 4 wherein a roller or wheel projects downwardly from and is attached to the horizontal segment of the inverted U-shaped tube, said roller or wheel being positioned on the outer edge of the gutter.

* * * * *